US009385480B2

(12) United States Patent
Miyoshi

(10) Patent No.: US 9,385,480 B2
(45) Date of Patent: Jul. 5, 2016

(54) CONNECTOR

(71) Applicant: Hosiden Corporation, Yao-shi (JP)

(72) Inventor: Toshiharu Miyoshi, Yao (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 14/333,896

(22) Filed: Jul. 17, 2014

(65) Prior Publication Data

US 2015/0024630 A1 Jan. 22, 2015

(30) Foreign Application Priority Data

Jul. 18, 2013 (JP) ..... 2013-149553

(51) Int. Cl.

| | |
|---|---|
| ***H01R 13/658*** | (2011.01) |
| ***H01R 13/506*** | (2006.01) |
| ***H01R 13/6581*** | (2011.01) |
| ***H01R 13/6594*** | (2011.01) |
| *H01R 13/627* | (2006.01) |

(52) U.S. Cl.

CPC ..... *H01R 13/658* (2013.01); *H01R 13/506* (2013.01); *H01R 13/6581* (2013.01); *H01R 13/6594* (2013.01); *H01R 13/6278* (2013.01)

(58) Field of Classification Search

USPC ..... 439/607.01, 607.17, 607.35, 607.54, 439/483

See application file for complete search history.

(56) References Cited

U.S. PATENT DOCUMENTS

| | | | | |
|---|---|---|---|---|
| 5,030,140 | A | 7/1991 | Sugiyama | |
| 5,035,651 | A * | 7/1991 | Dixon et al. | 439/607.17 |
| 6,375,515 | B1 * | 4/2002 | Higuchi | 439/676 |
| 6,506,075 | B2 * | 1/2003 | Chiran et al. | 439/607.01 |
| 7,001,216 | B1 * | 2/2006 | Huang | 439/607.54 |
| 7,785,149 | B2 * | 8/2010 | Kamata et al. | 439/607.35 |
| 2007/0224883 | A1 * | 9/2007 | Chan et al. | 439/607 |
| 2008/0124956 | A1 * | 5/2008 | Wu | 439/80 |
| 2008/0242142 | A1 | 10/2008 | Takeuuchi et al. | |
| 2010/0055979 | A1 * | 3/2010 | Wang et al. | 439/607.01 |
| 2012/0156921 | A1 * | 6/2012 | Annequin et al. | 439/449 |
| 2013/0178100 | A1 * | 7/2013 | Nagata et al. | 439/607.35 |

FOREIGN PATENT DOCUMENTS

| | | | |
|---|---|---|---|
| EP | 2466692 | A1 | 6/2012 |
| JP | 626174 | U | 4/1994 |
| JP | 729586 | Y2 | 7/1995 |
| JP | 997647 | A | 4/1997 |
| JP | 2008243689 | A | 10/2008 |

* cited by examiner

*Primary Examiner* — Alexander Gilman
(74) *Attorney, Agent, or Firm* — The Webb Law Firm

(57) ABSTRACT

Provided is a connector free from such inadvertent withdrawal or slip-out of the shell from the main body during insertion or drawing-out of the connection object. The connector includes a contact to be electrically connected to a connection object, a main body holding the contact, and a shell covering the main body. The main body includes a first end portion on a side to which the connection object is connected, a second end portion opposite to the first end portion, and a groove formed along a direction orthogonal to a connecting direction of the connection object; and the shell includes a projecting portion which projects to an inner side of the shell for engaging within the groove.

15 Claims, 7 Drawing Sheets

CONNECTOR

CROSS REFERENCE TO RELATED APPLICATION

This application is based on and claims priority under 35 U.S.C. Section 119 to Japanese Patent Application No. 2013-149553 filed on Jul. 18, 2013, the entire contents of which are incorporated herein by reference.

TECHNICAL FIELD

This disclosure relates to a connector to be electrically connected to a connection object, i.e. an object to be connected.

RELATED ART

There is known a connector whose main body is enclosed in a shell made of metal, for the sake of improvement of its EMI characteristics. For fixation between the shell and the main body, methods are known from e.g. Japanese Unexamined Patent Application No. 09-097647 and Japanese Unexamined Patent Application No. 2008-243689. According to the Japanese Unexamined Patent Application No. 09-097647, after a shield cover is placed over an insulating body, a back lid of the shield cover is bent for closure. According to the Japanese Unexamined Patent Application No. 2008-243689, after an insulating housing is inserted into a tubular shell, a cover wall provided in the shell is bent for preventing inadvertent slip-out of the insulating housing.

However, with these connectors, after the shell and the body are assembled together, the shell needs to be bent for fixation. Thus, there was possibility of failure of sufficient fixation between the shell and the body, due to insufficient bending or omission of the bending operation.

In addressing to the above problem, there has been proposed a fixing method disclosed in Japanese Examined Utility Model Publication No. 07-029586. According to this Japanese Examined Utility Model Publication No. 07-029586, a retaining pawl is provided in a shield frame and a groove is provided in a main body along a connecting direction to a connection object. With this fixing method, when the main body is inserted to the shield frame, the retaining pawl of the shield frame is engaged into the groove for realizing the fixation.

SUMMARY

With such connector above, however, as the direction of insertion to the connection object is same as the direction of retention between the shield frame and the main body. Hence, when the connection object is inserted or drawn out with a strong force, the main body may be slipped out of the shield frame inadvertently.

According to a preferred embodiment of the present invention, there is provided a connector free from such inadvertent slip-out of the shell from the main body during insertion or drawing-out of the connection object.

According to one preferred embodiment of the present invention, a connector comprises:

a contact to be electrically connected to a connection object;

a main body holding the contact; and a shell covering the main body;

wherein the main body includes a first end portion on a side to which the connection object is connected, a second end portion opposite to the first end portion, and a groove formed along a direction orthogonal to a connecting direction of the connection object; and the shell includes a projecting portion which projects to an inner side of the shell for engaging within the groove.

With the above-described arrangement, with engagement of the projecting portion of the shell within the groove of the main body, the shell and the main body can be fixed to each other. Further, as the groove is formed along a direction orthogonal to the connecting direction of the connection object, the shell and the main body can be fixed more strongly than an arrangement wherein the groove is formed along a direction parallel with the connecting direction of the connection object. Moreover, since the projecting portion is not formed by bending after assembly of the connector, there is no possibility of omission of bending or insufficient bending. Also, since the shell can be formed prior to the connector assembly, this shell can be formed of a material having high strength. Further, if the projecting portion is formed of a plate-like member, it is possible to secure a large area for the contact between the groove and the projecting portion. Consequently, the shell and the main body can be fixed even more strongly.

According to a further preferred embodiment of the present invention:

the main body includes a back face on the side of the second end portion;

the shell includes a back face portion covering the back face, a lateral portion extending from a lateral end of the back face portion toward the side of the first end portion; and the projecting portion is formed at an end of the lateral portion on the side of the first end portion.

With the above arrangement, even when a force is applied to the projecting portion during insertion or withdrawal of the connection object, this force can be dissipated effectively to the lateral portion where the projecting portion is formed and the back face portion to which the lateral portion extends. Therefore, in comparison with an arrangement wherein the projecting portion is provided in a lateral wall of the shell, the projecting portion can be provided with a higher strength. Further, for instance, if the lateral portion and the projecting portion of the shell are formed by bending of the back face portion, these components can be formed of a single member, so that the manufacture of the connector can be easily carried out and the costs thereof can be reduced advantageously.

According to a still further preferred embodiment of the present invention, the shell has a lateral wall and the lateral portion includes a fixed portion to be retained and fixed to the lateral wall.

With the above-described arrangement, the lateral wall and the back face portion of the shell can be fixed to each other, so that the shell can be formed strong.

According to a still further preferred embodiment of the present invention:

the main body includes a first main body and a second main body;

the second main body includes an inserted portion to be inserted into the first main body from the side of the second end portion;

the groove is formed in the first main body to extend through this first main body;

the inserted portion includes a cutout that establishes communication with the groove; and the cutout includes a contact face that comes into contact with the projecting portion from the side of the first end portion.

With the above-described arrangement, the projecting portion of the shell can serve for prevention of displacement of the shell toward the first end portion side and the second end portion side and serve also for prevention of displacement of the second main body toward the second end portion, simultaneously. Accordingly, even when the main body is composed of a plurality of members, there is no need to provide any member(s) for fixing these constituent members to each other. As a result, the construction can be simple.

According to a still further preferred embodiment of the present invention:

the shell is fitted on the main body along the direction orthogonal to the connecting direction of the connection object;

the shell includes a lateral wall;

the lateral wall forms an elastic portion that projects to an inner side of the shell and is deformable outward an outer side of the shell;

the main body includes a recessed portion into which the elastic portion comes into engagement; and the recessed portion includes a restricting face restricting displacement of the shell when the elastic portion comes into contact with the recessed portion from a downstream side of an attaching direction of the shell.

With the above-described arrangement, even if a force is applied in a direction to release the outward engagement or fitting-on of the shell, the elastic portion engaged within the recessed portion will come into contact with the contact face, thus effectively preventing release of the outward engagement of the shell.

According to a still further preferred embodiment of the present invention:

the shell is fitted on the main body along the direction orthogonal to the connecting direction of the connection object;

the shell includes a lateral wall;

the lateral wall forms a projecting piece extending toward a downstream side of an attaching direction of the shell; and the lateral wall of the main body forms an opening which opens on an upstream side of the attaching direction of the shell and into which the projecting piece is inserted.

With the above-described arrangement, when the shell is fitted on the main body, the projecting piece formed in the shell will be inserted into the opening formed in the main body. With this, even if the shell is exposed to a force toward the first end side or the second end side in association with insertion/withdrawal of the connection object, the projecting piece will come into contact with an inner face of the opening, thus effectively preventing inadvertent withdrawal or slip-out of the shell from the main body. Therefore, the shell and the main body can be fixed together even more strongly.

DESCRIPTION OF EMBODIMENTS

Figure 1:
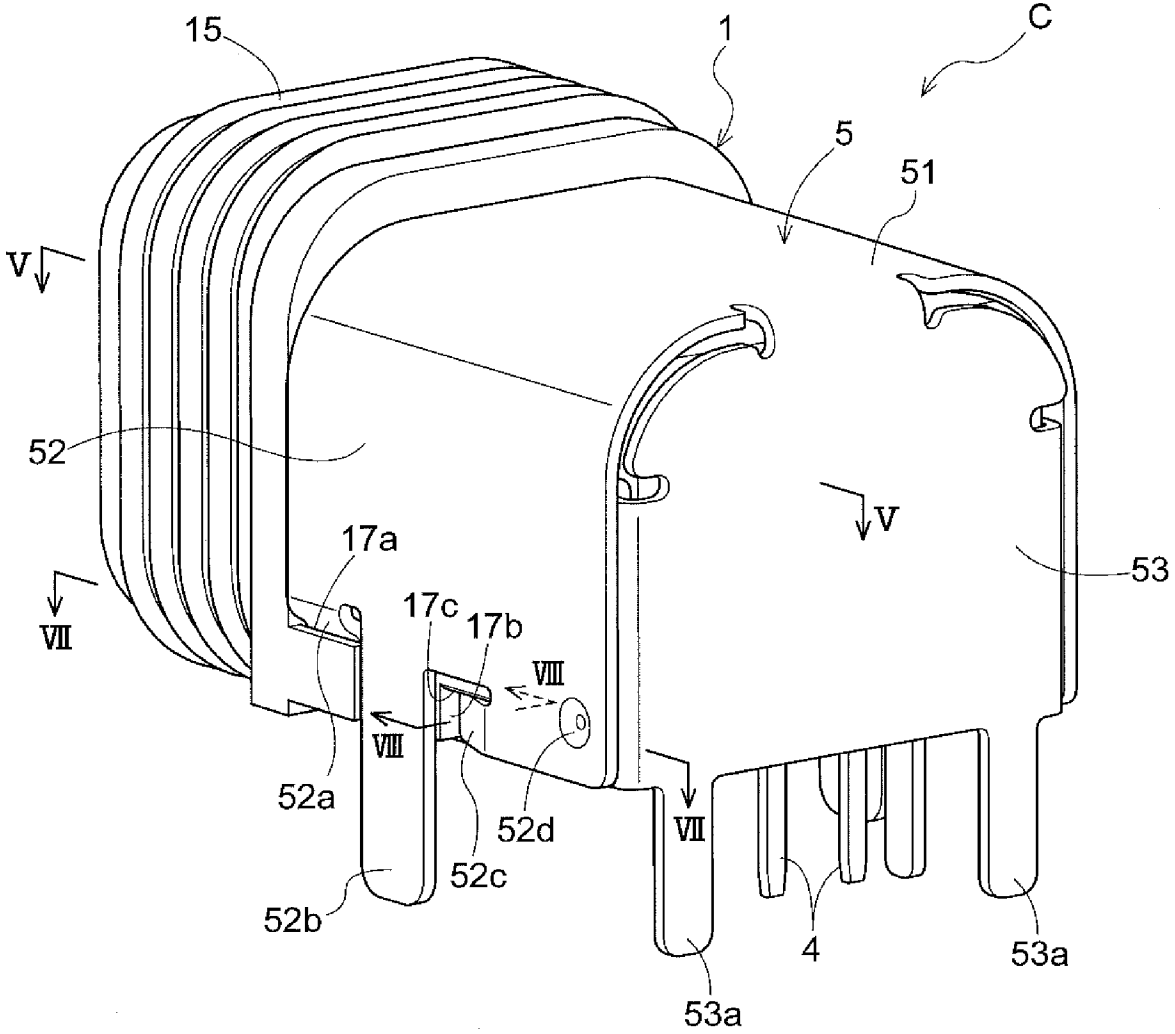
FIG. 1 is an upper perspective view of a connector.
Figure 2:
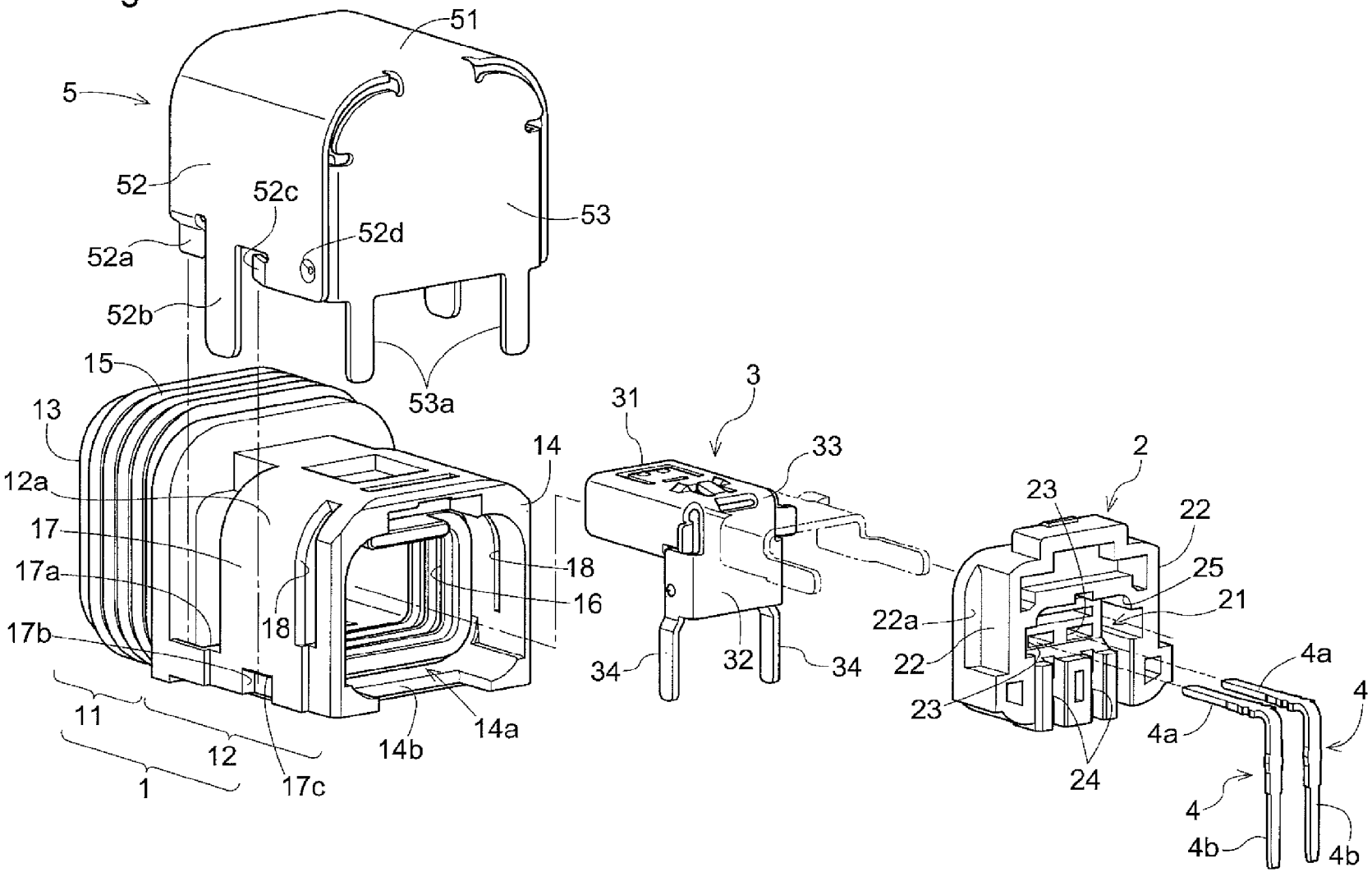
FIG. 2 is an exploded perspective view of the connector as seen from its rear upper side.
Figure 3:
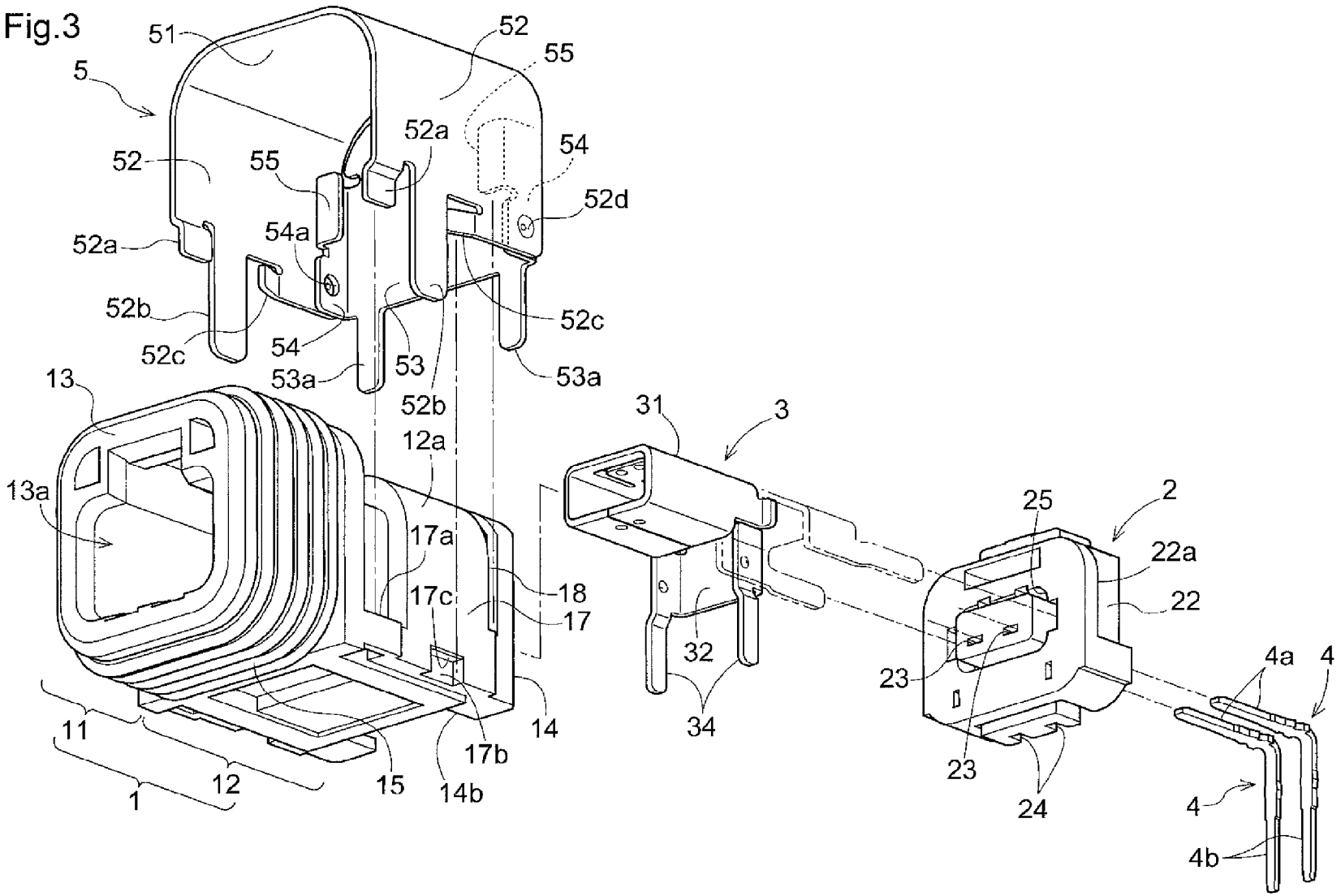
FIG. 3 is an exploded perspective view of the connector as seen from its front lower side.
Figure 4:
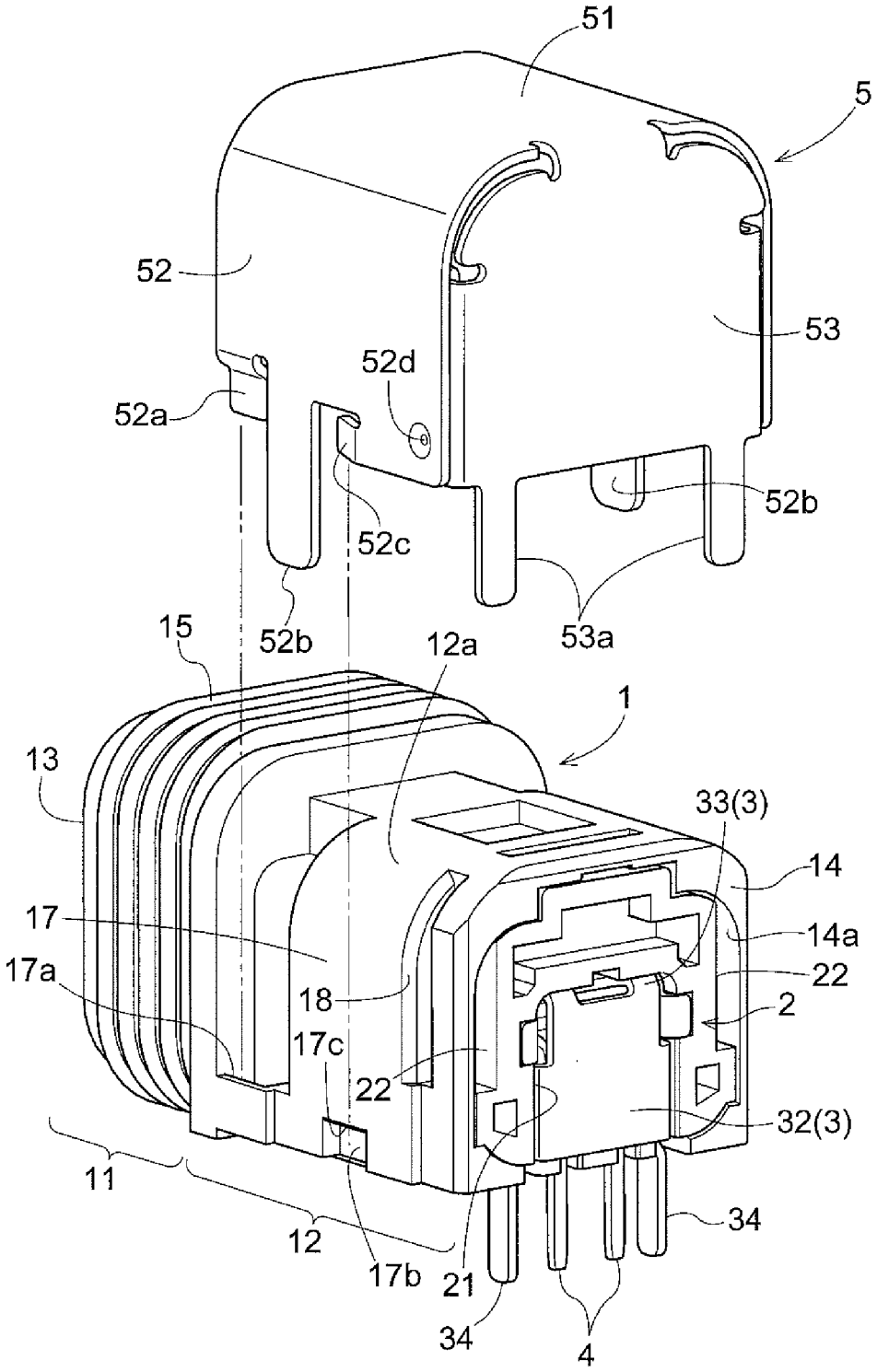
FIG. 4 is a partially exploded perspective view of the connector as seen from its rear side.
Figure 5:
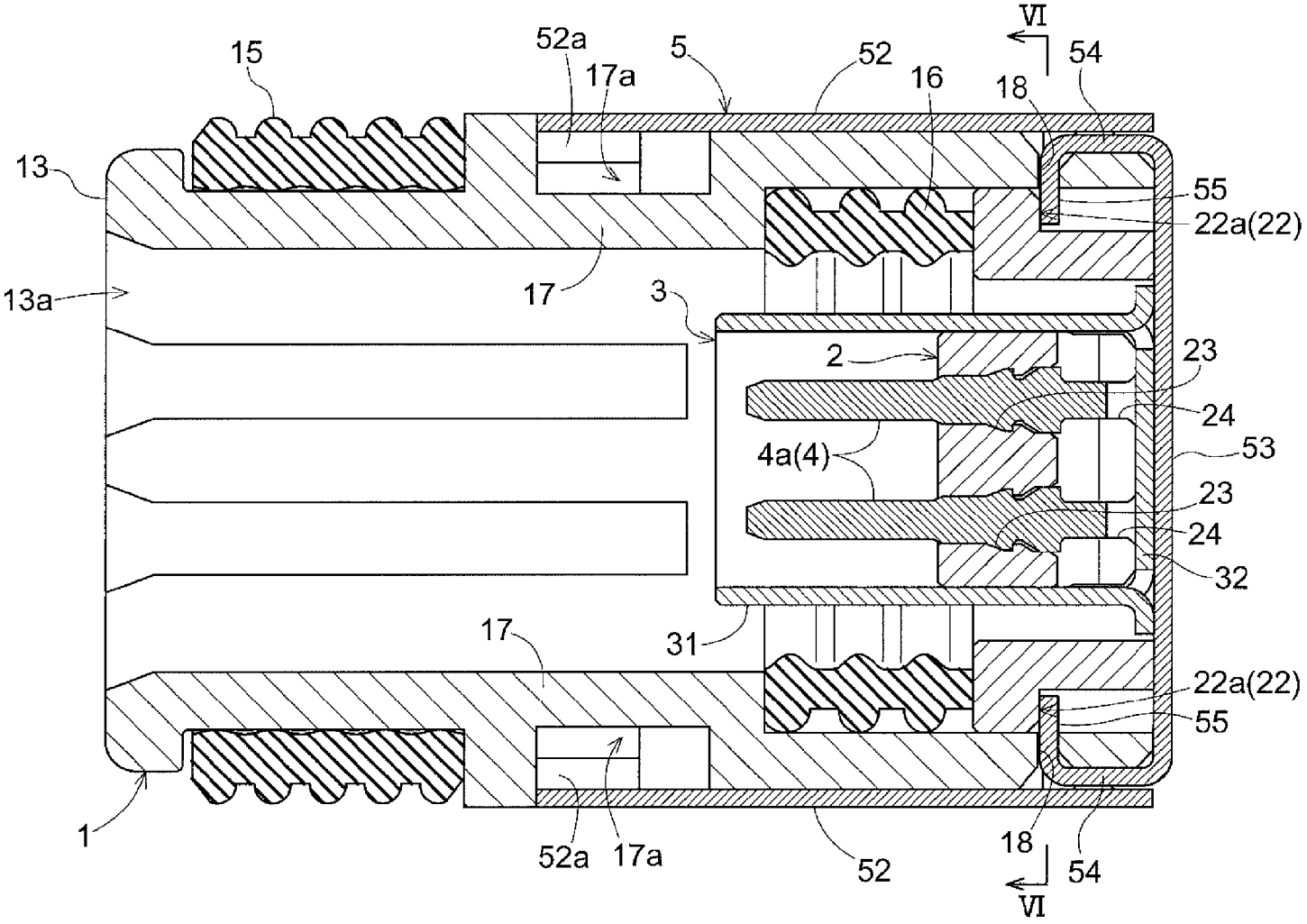
FIG. 5 shows an upper view in horizontal section of the connector.
Figure 6:
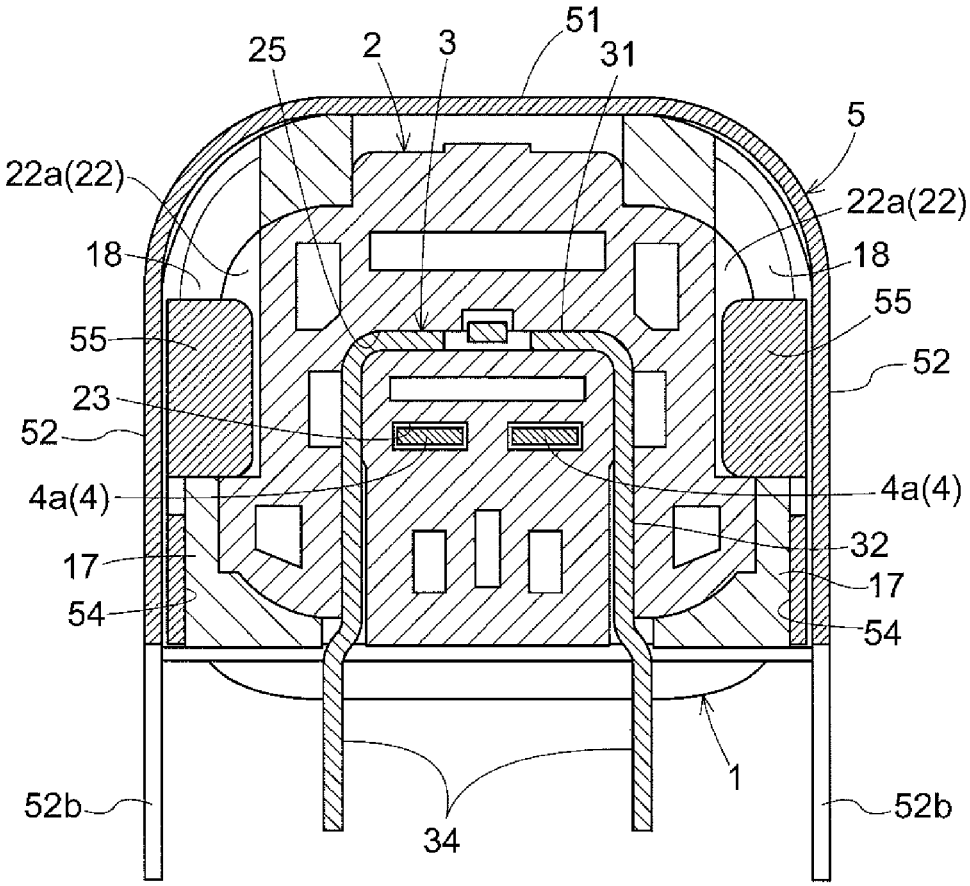
FIG. 6 shows a rear view in section of the connector.
Figure 7:
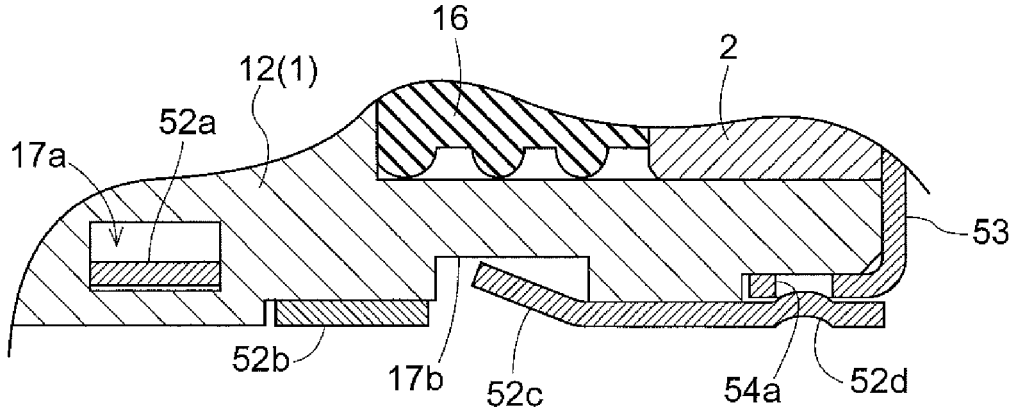
FIG. 7 is a partially enlarged view in section of the connector as seen from its upper side.
Figure 8:
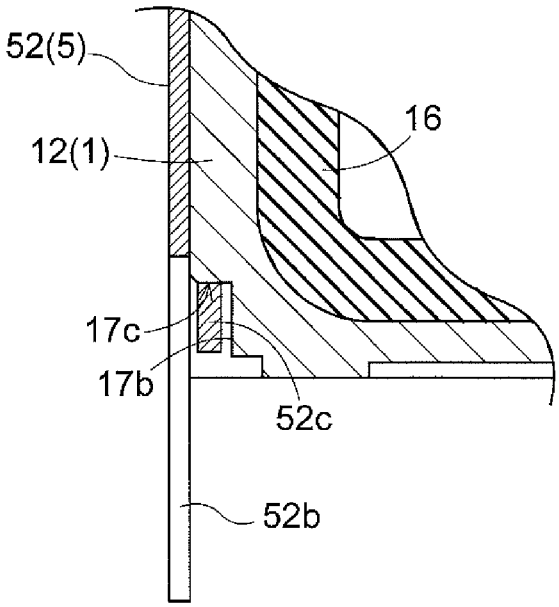
FIG. 8 is a partially enlarged view in rear section of the connector.

Next, with reference to the accompanying drawings, an embodiment of a connector C relating to the present invention will be described. FIG. 1 is an upper perspective view of the connector C according to the instant embodiment. FIGS. 2 and 3 are exploded perspective views of the connector C as seen from its rear upper side and from its front lower side, respectively. FIG. 4 is a partially exploded perspective view of the connector as seen from its upper side. FIG. 5 shows a section along V-V in FIG. 1 of the connector C. FIG. 6 shows a section along VI-VI in FIG. 5 of the connector C. FIG. 7 is a partially enlarged view in section along VII-VII in FIG. 1 of the connector C. FIG. 8 is a partially enlarged view in section along VIII-VIII in FIG. 1 of the connector C. Incidentally, in the instant embodiment, the upper and lower sides are defined relative to a reference condition where the connector C is placed as illustrated in FIG. 1. Further, the side to which a connection object is connected (the left side in FIG. 1) is defined as the front side and the side opposite thereto (or away therefrom) is defined as the rear side, respectively.

The connector C includes a main body formed of an insulator such as resin. In the instant embodiment, as shown in FIG. 2, the main body consists of a first main body 1 and a second main body 2. The connector C further includes contacts 4 to be held in the second main body 2, a metal body 3 to be attached to the second main body 2 and covering the contacts 4, and a shell 5 formed of metal and covering the first main body 1.

The first main body 1 has a tubular shape and includes a connected portion 11 to which a connection object (not shown) is to be connected and a cover portion 12 to be covered by the shell 5. As shown in FIG. 3, at a front end portion of the connected portion 11, there is formed a first opening 13*a* to which the connection object is to be connected. Further, as shown in FIG. 2, in a back face of the cover portion 12 as a rear end portion thereof, there is formed a second opening 14*a* into which the second main body 2 is to be inserted. And, along an outer circumference of the connected portion 11, a first packing 15 is fitted on for allowing close contact with an inner circumferential face of a box body of the connection object. Moreover, on the inner side of the cover portion 12, there is inwardly engaged a second packing 16 in contact with the inner circumferential face of the cover portion 12. At opposed lateral ends of the upper face of the cover portion 12, curved portions 12*a* are formed. Incidentally, the front side end of the first main body 1 is what is referred to as the "first end portion 13" and the rear side end of the first main body 1 is what is referred to as the "second end portion 14", in the context of the present invention, respectively.

When the connection object is connected to the first opening 13*a*, terminals of this connection object come into contact, inside the first main body 1, with the contacts 4 held within the second main body 2. With this, electrical connection is established between the terminals of the connection object and the contacts 4.

As shown in FIG. 2, the upper face of the cover portion 12 is formed lower than the upper face of the connected portion 11. Further, the cover portion 12 includes lateral walls 17 on the opposed sides thereof and in each one of these lateral walls 17, there are formed an opening portion 17*a*, a recessed portion 17*b*, and a groove 18 in this mentioned order from the front side. Also, a cutout portion 14*b* is formed at a rear end center of the bottom wall of the cover portion 12.

The opening portion 17*a* is formed by cutting out the lateral wall 17 of the first main body 1 with leaving a predetermined amount of its lower end portion, so that the opening portion 17*a* is formed at this lower end portion as a hole extending through from the upper side to the lower side.

The recessed portion 17*b* is formed by cutting out the lower end of the lateral wall 17 by a predetermined width. Also, at the upper end of the recessed portion 17*b*, there is formed a restricting face 17*c* restricting upward displacement of the shell 5.

The groove 18 is formed as a vertically elongate hole extending from the curved portion 12*a* to an intermediate position of the lateral wall 17 and extending through from the outer side to the inner side of the lateral wall 17.

The second main body 2, with the metal body 3 attached thereto in advance, will be engaged from the rear side of the first main body 1 into the second opening portion 14*a*. In the course of this, the front end face of the second main body 2 will come into contact with the rear end face of the second packing 16 provided inside the first main body 1 (see FIG. 5). Incidentally, in the second main body 2, a portion thereof inserted into the first main body 1 is what is referred to as "an inserted portion" in the context of the present invention. In the instant embodiment, the entirety of the second main body 2 constitutes this inserted portion.

As shown in FIG. 2, at opposed lateral portions of the second main body 2, cutouts 22 are formed. Also, in the back face of the second main body 2, there is formed a recessed portion 21 to which a cover portion 32 of the metal body 3 is to be attached. Within this recessed portion 21, there are formed contact holes 23 and holding grooves 24 for fixing the contacts 4 and an U-shaped hole 25 into which the metal body 3 is to be inserted.

The cutout 22 is formed by cutting out a rear portion of each lateral portion of the second main body 2 from the upper side. Further, the front end face of the cutout 22 includes a contact face 22*a* to which a projecting portion 55 of the shell 5 comes into contact from the rear side.

The contact hole 23 is formed near the center of the front end face of the recessed portion 21, with the contact hole 23 extending through toward the front side of the second main body 2. Further, inside the recessed portion 21, the holding grooves 24 holding the contacts 4 are formed as vertically elongate grooves. Each contact 4 includes a contacting portion 4*a* coming into contact with a terminal of the connection object and an inserting portion 4*b* to be inserted into a circuit board. In the instant embodiment, the contact 4 is formed with its inserting portion 4*b* being bent from the rear end of the contacting portion 4*a* to extend downwards. The contact 4 will be held to the second main body 2 as its contacting portion 4*a* is inserted into the contact hole 23 from the rear side of the second main body 2 and an upper portion of the inserting portion 4*b* being fitted within the holding groove 24.

As described above, to the second main body 2, the metal body 3 covering the contacts 4 will be attached (see FIGS. 4-6). As shown in FIG. 2 and FIG. 3, this metal body 3 includes a tubular body 31, the cover portion 32, a bent portion 33 and leg portions 34.

The tubular body 31 engaged into the U-shaped hole 25 of the second main body 2 from the first end side, thus being fixed to this second main body 2, is configured to surround the contacting portions 14*a* of the contacts 4. Also, the cover portion 32 is formed to extend downwards from the rear end of the upper face of the tubular body 31 via the bent portion 33.

The leg portions 34 are formed to extend downwards from opposed lateral ends of the cover portion 32 and will be inserted into holes formed in the circuit board.

In the metal body 3, under its conditions illustrated in FIG. 2 and FIG. 3, the upper face of the tubular body 31 and the back face of the cover portion 32 extend substantially orthogonal to each other. However, prior to its attachment to the second main body 2, the upper face of the tubular body 31 and the back face of the cover portion 32 are located in a same plane (the condition indicated by two-dot lines). And, when the metal body 3 is to be attached to the second main body 2, the cover portion 32 will be firstly inserted into the U-shaped hole 25 of the second main body 2 from the front side and will then be bent downwards at the bent portion 33 to be eventually engaged into the recessed portion 21 of the second main body 2. Under this condition, the back face of the second main body 2 and the back face of the cover portion 32 of the metal body 3 are located in a same plane.

The shell 5 will be fitted onto (i.e. engaged outwardly over) the cover portion 12 of the first main body 1 from the upper side. As shown in FIGS. 2-4, the shell 5 includes an upper face portion 51 covering an upper face of the cover portion 12, lateral walls 52 covering the lateral walls 17 of the cover portion 12 and a back face portion 53 covering the back faces of the first main body 1 and the second main body 2.

The lateral walls 52 of the shell 5 are formed to extend downwards from opposed lateral ends of the upper face portion 51 of the shell 5. In the instant embodiment, the upper face portion 51 and the lateral walls 52 are formed by bending a single metal plate member. In this, the opposed lateral ends of the upper face portion 51 will be formed in a curved shape to extend along the contours of the curved portions 12*a* of the first main body 1. Further, in each one of the opposed lateral walls 52 of the shell 5, there are formed a projecting piece 52*a*, a first leg portion 52*b*, an elastic portion 52*c* and a fixing portion 52*d* in this mentioned order from the front side.

The projecting piece 52*a* is formed to extend from the lower end of the lateral wall 52 of the shell 5 and is bent obliquely downwards from its base end portion to the inner side and then is bent further downwards.

The first leg portion 52*b* is formed to extend downwards from the lower end of the lateral wall 52 and inserted into the hole formed in the circuit board.

The elastic portion 52*c* is formed at the lower end of the lateral wall 52 as a projecting piece projecting inwardly to the front side. More particularly, a cutout piece will be formed by cutting out the lateral wall 52 from the front side to the rear side and then, a leading end of this cutout piece will be bent inwardly, thereby forming the elastic portion 52*c*.

The fixing portion 52*d* is provided at a lower portion of the rear end portion of the lateral wall 52 and is formed as a projection projecting inwards.

The back face portion 53 of the shell 5 is formed to extend downwards from the rear end of the upper face portion 51. In the instant embodiment, when the shell 5 is fitted on/over the first main body 1, the inner face of the back face portion 53 will come into face-contact with the back faces of the first main body 1 and the second main body 2. Further, in this embodiment, the back face portion 53 is formed of the same single metal plate member which forms the upper face portion 51 and the lateral walls 52, and this back face portion 53 is formed as being bent downwards at the rear end of the upper face portion 51. Further, as shown in FIG. 3, the back face portion 53 includes lateral portions 54, the projecting portions 55 and second leg portions 53*a*.

The lateral portions 54 are formed as being bent toward the front side from opposed lateral ends of the back face portion 53. Further, at lower portions of the lateral portions 54, there are formed fixed portions 54*a* in the form of through holes to be fixed to the fixing portions 52*d* of the lateral walls 52. As the fixing portions 52*d* formed in the lateral walls 52 of the shell 5 described above are engaged into these, the lateral walls 52 and the back face portion 53 will be retained and fixed to each other (see FIG. 7).

Each projecting portion 55 is formed to extend inwardly from an upper portion of the front end portion of the lateral portion 54. In this embodiment, the projecting portion 55 is formed like a plate-like projecting piece and is formed as being bent at the front end of the lateral portion 54.

The second leg portions 53*a* extend from the lower ends adjacent the opposed lateral ends of the back face portion 53 and will be inserted into holes formed in the circuit board, like the first leg portions 52*b*.

Next, there will be explained a method of assembling the connector C.

Firstly, as described hereinbefore, the contacts 4 and the metal body 3 are assembled to the second main body 2. And, as the second main body 2 is inserted into the second opening portion 14*a* of the first main body 1, the front end face of the second main body 2 is brought into contact with the rear end face of the second packing 16 mounted within the first main body 1. In this stage, the back faces of the second main body 2 and the metal body 3 are located in a same plane as the back face of the first main body 1. Further, in this same stage, the cutouts 22 of the second main body 2 are communicated with the grooves 18 of the first main body 1, and the front faces inside the grooves 18 and the contact faces 22*a* of the cutouts 22 are located in a same plane (see FIG. 5).

Further, as shown in FIG. 4, when the second main body 2 is inserted to the first main body 1, the inserting portions 4*b* of the contacts 4 and the leg portions 34 of the metal body 3 extend more downwards through the cutout 14*b* of the first main body 1 than the lower face of the connector C. And, these will be inserted into holes provided in the circuit board. With this, the first main body 1 will be fixed in position relative to the circuit board and also the contacts 4 and the metal body 3 will be connected to the circuit board.

Next, the shell 5 is fitted onto the cover portion 12 of the first main body 1 from the upper side. Under this condition, the projecting portions 55 of the shell 5 will be engaged into the grooves 18. In the instant embodiment, as the grooves 18 are formed along the direction orthogonal to the connecting direction of the connection object, when the connection object is inserted or withdrawn, the projecting portions 55 of the shell 5 will come into contact with the inner faces of the grooves 18, thus effectively preventing displacement of the shell 5 in the front/rear direction. In particular, in the instant embodiment, as each projecting portion 55 is provided as a plate-like projecting piece which comes into face-contact with the inner face of the groove 18, the shell 5 and the first main body 1 can be fixed to each other more strongly. Accordingly, it is possible to prevent inadvertent withdrawal or slipping-out of the shell 5 from the first main body 1. Moreover, in the instant embodiment, since the shell 5 is fitted on in the direction along which the grooves 18 are formed, the possibility of damage of the projecting portions 55 with the outward engagement of the shell 5 is lessened. And, since there is no need to elastically deform or to bend the shell 5 at the time of or after the assembly of the connector C, the shell 5 and the projecting portions 55 can be formed of material having high strength.

Further, in this embodiment, the lateral portions 54 extend from the lateral ends of the back face portion 53 of the shell 5 and the projecting portions 55 extend from these lateral portions 54. Therefore, even when a force is applied to the projecting portions 55 in association with insertion or withdrawal of the connection object, this force can be dissipated to the lateral portions 54 and the back face portion 53 of the shell 5. Consequently, the projecting portions 55 can be provided with high strength, so that inadvertent withdrawal or slipping-out of the shell 5 from the first main body 1 can be effectively prevented. Moreover, since the lateral portions 54 of the shell 5 are retained and fixed to the lateral walls 52 of the shell 5, the back face portion 53 and the lateral walls 52 of the shell 5 can be fixed to each other, so that the shell 5 can be formed strong.

Further, in the instant embodiment, when the shell 5 is fitted on the first main body 1, as shown in FIG. 5 and FIG. 6, the projecting portions 55 of the shell 5 are engaged into the grooves 18 of the first main body 1 and also come into contact with the contact faces 22*a* of the cutouts 22. With this, the projecting portions 55 of the shell 5 can serve for the fixation between the first main body 1 and the shell 5 and serve also for prevention of rearward displacement of the second main body 2, simultaneously. Accordingly, even when the main body is composed of a plurality of members, there is no need to provide any member(s) for fixing these constituent members to each other. As a result, the construction can be simple. Furthermore, as described above, in the instant embodiment, since the back face portion 53 of the shell 5 comes into face-contact with the back face of the second main body 2, rearward displacement of the second main body 2 can be prevented by this contact also.

When the shell 5 is fitted on the first main body 1, the projecting pieces 52*a* of the lateral walls 52 of the shell 5 are inserted into the opening portions 17*a* of the first main body 1 (see FIG. 7). With this, even when the connection object is inserted or withdrawn, as the projecting pieces 52*a* come into contact with the inner faces of the opening portions 17*a*, inadvertent withdrawal or slipping-out of the shell 5 from the first main body 1 in the front/rear direction can be effectively prevented.

Moreover, when the shell 5 is fitted on the first main body 1, the elastic portions 52*c* of the shell 5 come into contact with the curved portions 12*a* of the first main body 1, thus being elastically deformed outwards. Then, these elastically deformed elastic portions 52*c* will move downwards as sliding along the lateral walls 17 of the first main body 1 and will be elastically resiled, upon reaching the positions of the recessed portions 17*b* (see FIG. 7 and FIG. 8).

With this, the elastic portions 52*c* will be engaged into the recessed portions 17*b*. Therefore, even when the shell 5 is exposed to an upper pulling or withdrawing force, as the upper ends of the elastic portions 52*c* come into contact with the restricting faces 17*c* of the recessed portions 17*b*, upward displacement of the shell 5 can be effectively prevented. Therefore, the shell 5 and the first main body 1 can be fixed to each other even more strongly.

Further, simultaneously with the fitting of the shell 5 onto the first main body 1, the first leg portions 52*b* and the second leg portions 53*a* of the shell 5 will be inserted into the holes provided in the circuit board. With this, the circuit board and the shell 5 can be fixed to each other.

Other Embodiments (1) In the foregoing embodiment, the projecting portion 55 is provided to extend at an end of the lateral portion 54 extending from the back face portion 53. However, the projecting portion 55 can be formed at any desired portion of the shell 5 as long as it can engage into the groove 18 of the first main body 1. For instance, it can be formed in the lateral wall 52 of the shell 5.

(2) In the foregoing embodiment, the shell 5 is formed by bending a single member. Instead, the shell 5 can be formed of separate members.

(3) In the foregoing embodiment, the main body of the connector C includes the first main body 1 and the second main body 2. Instead, the main body can be formed of a single member. In this case, the groove 18 formed in the first main body 1 need not extend therethrough as long as it allows engagement of the projecting portion 55 therein.

(4) In the foregoing embodiment, the cutouts 22 are formed in the second main body 2 and these cutouts 22 include the contact faces 22*a*. However, these contact faces can be omitted.

(5) In the foregoing embodiment, the shell 5 is provided with the projecting pieces 52*a* and the elastic portions 52*c* whereas the first main body 1 is provided with the opening portions 17*a* and the recess portions 17*b*. However, these portions need not be formed.

(6) In the foregoing embodiment, the fixing portions 52*d* of the lateral walls 52 of the shell 5 are provided as projections and the fixed portions 54*a* of the lateral portions 54 are formed as through holes. However, the invention is not limited to any particular fixing method as long as the method allows retention/fixation between the lateral walls 52 and the lateral portions 54. Further, the lateral walls 52 and the lateral portions 54 need not be retained and fixed to each other.

(7) In the foregoing embodiment, the shell 5 and the metal body 3 respectively form the leg portions 34. However, these need not be formed at all.

INDUSTRIAL APPLICABILITY

The present invention is applicable to a connector to be electrically connected to a connection object.

The invention claimed is:

1. A connector comprising:

a contact to be electrically connected to a connection object;

a main body holding the contact; and a shell covering the main body;

wherein the main body includes a first end portion on a side to which the connection object is connected, a second end portion opposite to the first end portion, a groove formed along a direction orthogonal to a connecting direction of the connection object, and a back face on a side of the second end portion;

wherein the shell includes a back face portion covering the back face, a lateral portion extending from a lateral end of the back face portion toward the side of the first end portion, and a projecting portion which projects inward from an end of the lateral portion on the side of the first end portion to engage within the groove;

wherein the shell has a lateral wall and the lateral portion includes a fixed portion to be retained and fixed to the lateral wall.

2. The connector according to claim 1, wherein:

the main body includes a first main body and a second main body;

the second main body includes an inserted portion to be inserted into the first main body from the side of the second end portion;

the groove is formed in the first main body to extend through this first main body;

the inserted portion includes a cutout that establishes communication with the groove; and the cutout includes a contact face that comes into contact with the projecting portion from the side of the first end portion.

3. The connector according to claim 2, wherein:

the shell is fitted on the main body along the direction orthogonal to the connecting direction of the connection object;

the shell includes a lateral wall;

the lateral wall forms an elastic portion that projects to an inner side of the shell and is deformable outward an outer side of the shell;

the main body includes a recessed portion into which the elastic portion comes into engagement; and the recessed portion includes a restricting face restricting displacement of the shell when the elastic portion comes into contact with the recessed portion from a downstream side of an attaching direction of the shell.

4. The connector according to claim 2, wherein:

the shell is fitted on the main body along the direction orthogonal to the connecting direction of the connection object;

the shell includes a lateral wall;

the lateral wall forms a projecting piece extending toward a downstream side of an attaching direction of the shell; and the lateral wall of the main body forms an opening which opens on an upstream side of the attaching direction of the shell and into which the projecting piece is inserted.

5. The connector according to claim 1, wherein:

the shell is fitted on the main body along the direction orthogonal to the connecting direction of the connection object;

the shell includes a lateral wall; the lateral wall forms an elastic portion that projects to an inner side of the shell and is deformable outward an outer side of the shell;

the main body includes a recessed portion into which the elastic portion comes into engagement; and the recessed portion includes a restricting face restricting displacement of the shell when the elastic portion comes into contact with the recessed portion from a downstream side of an attaching direction of the shell.

6. The connector according to claim 1, wherein:

the shell is fitted on the main body along the direction orthogonal to the connecting direction of the connection object;

the shell includes a lateral wall;

the lateral wall forms a projecting piece extending toward a downstream side of an attaching direction of the shell; and the lateral wall of the main body forms an opening which opens on an upstream side of the attaching direction of the shell and into which the projecting piece is inserted.

7. A connector comprising:

a contact to be electrically connected to a connection object;

a main body holding the contact; and a shell covering the main body;

wherein the main body includes a first end portion on a side to which the connection object is connected, a second end portion opposite to the first end portion, and a groove formed along a direction orthogonal to a connecting direction of the connection object;

wherein the shell includes a projecting portion which projects to an inner side of the shell for engaging within the groove;

wherein the main body includes a first main body and a second main body;

wherein the second main body includes an inserted portion to be inserted into the first main body from the side of the second end portion;

wherein the groove is formed in the first main body to extend through this first main body;

wherein the inserted portion includes a cutout that establishes communication with the groove; and wherein the cutout includes a contact face that comes into contact with the projecting portion from the side of the first end portion.

8. The connector according to claim 7, wherein:

the shell is fitted on the main body along the direction orthogonal to the connecting direction of the connection object;

the shell includes a lateral wall;

the lateral wall forms an elastic portion that projects to an inner side of the shell and is deformable outward an outer side of the shell;

the main body includes a recessed portion into which the elastic portion comes into engagement; and the recessed portion includes a restricting face restricting displacement of the shell when the elastic portion comes into contact with the recessed portion from a downstream side of an attaching direction of the shell.

9. The connector according to claim 7, wherein:

the shell is fitted on the main body along the direction orthogonal to the connecting direction of the connection object;

the shell includes a lateral wall;

the lateral wall forms a projecting piece extending toward a downstream side of an attaching direction of the shell; and the lateral wall of the main body forms an opening which opens on an upstream side of the attaching direction of the shell and into which the projecting piece is inserted.

10. A connector comprising:

a contact to be electrically connected to a connection object;

a main body holding the contact; and a shell covering the main body;

wherein the main body includes a first end portion on a side to which the connection object is connected, a second end portion opposite to the first end portion, and a groove formed along a direction orthogonal to a connecting direction of the connection object;

wherein the shell includes a projecting portion which projects to an inner side of the shell for engaging within the groove;

wherein the shell is fitted on the main body along the direction orthogonal to the connecting direction of the connection object;

wherein the shell includes a lateral wall;

wherein the lateral wall forms an elastic portion that projects to an inner side of the shell and is deformable outward an outer side of the shell;

wherein the main body includes a recessed portion into which the elastic portion comes into engagement; and wherein the recessed portion includes a restricting face restricting displacement of the shell when the elastic portion comes into contact with the recessed portion from a downstream side of an attaching direction of the shell.

11. The connector according to claim 10, wherein:

the shell is fitted on the main body along the direction orthogonal to the connecting direction of the connection object;

the shell includes a lateral wall;

the lateral wall forms a projecting piece extending toward a downstream side of an attaching direction of the shell; and the lateral wall of the main body forms an opening which opens on an upstream side of the attaching direction of the shell and into which the projecting piece is inserted.

12. A connector comprising:

a contact to be electrically connected to a connection object;

a main body holding the contact; and a shell covering the main body;

wherein the main body includes a first end portion on a side to which the connection object is connected, a second end portion opposite to the first end portion, a groove formed along a direction orthogonal to a connecting direction of the connection object, and a back face on a side of the second end portion;

wherein the shell includes a back face portion covering the back face, a lateral portion extending from a lateral end of the back face portion toward the side of the first end portion, and a projecting portion which projects inward from an end of the lateral portion on the side of the first end portion to engage within the groove;

the main body includes a first main body and a second main body;

the second main body includes an inserted portion to be inserted into the first main body from the side of the second end portion;

the groove is formed in the first main body to extend through this first main body;

the inserted portion includes a cutout that establishes communication with the groove; and the cutout includes a contact face that comes into contact with the projecting portion from the side of the first end portion.

13. The connector according to claim 12, wherein:

the shell is fitted on the main body along the direction orthogonal to the connecting direction of the connection object;

the shell includes a lateral wall;

the lateral wall forms an elastic portion that projects to an inner side of the shell and is deformable outward an outer side of the shell;

the main body includes a recessed portion into which the elastic portion comes into engagement; and the recessed portion includes a restricting face restricting displacement of the shell when the elastic portion comes into contact with the recessed portion from a downstream side of an attaching direction of the shell.

14. The connector according to claim 12, wherein:

the shell is fitted on the main body along the direction orthogonal to the connecting direction of the connection object;

the shell includes a lateral wall;

the lateral wall forms a projecting piece extending toward a downstream side of an attaching direction of the shell; and the lateral wall of the main body forms an opening which opens on an upstream side of the attaching direction of the shell and into which the projecting piece is inserted.

15. A connector comprising:

a contact to be electrically connected to a connection object;

a main body holding the contact; and a shell covering the main body;

wherein the main body includes a first end portion on a side to which the connection object is connected, a second end portion opposite to the first end portion, a groove formed along a direction orthogonal to a connecting direction of the connection object, and a back face on a side of the second end portion;

wherein the shell includes a back face portion covering the back face, a lateral portion extending from a lateral end of the back face portion toward the side of the first end portion, and a projecting portion which projects inward from an end of the lateral portion on the side of the first end portion to engage within the groove;

the shell is fitted on the main body along the direction orthogonal to the connecting direction of the connection object;

the shell includes a lateral wall;

the lateral wall forms a projecting piece extending toward a downstream side of an attaching direction of the shell; and the lateral wall of the main body forms an opening which opens on an upstream side of the attaching direction of the shell and into which the projecting piece is inserted.

* * * * *